US006082344A

United States Patent [19]

Ito et al.

[11] Patent Number: 6,082,344

[45] Date of Patent: Jul. 4, 2000

[54] IGNITION DEVICE FOR AN INTERNAL COMBUSTION ENGINE

[75] Inventors: Takashi Ito, Hitachinaka; Katsuaki Fukatsu; Ryoichi Kobayashi, both of Ibaraki-ken; Yuichi Kashimura, Hitachinaka, all of Japan

[73] Assignees: Hitachi, Ltd., Tokyo; Hitachi Car Engineering Co., Ltd., Ibaraki-ken, both of Japan

[21] Appl. No.: 09/105,273

[22] Filed: Jun. 26, 1998

[30] Foreign Application Priority Data

Jun. 26, 1997 [JP] Japan ..... 9-170497

[51] Int. Cl.[7] ..... F02P 15/00; H01F 38/12

[52] U.S. Cl. ..... 123/630; 123/645; 123/655

[58] Field of Search ..... 123/630, 655, 123/656, 625, 645, 622

[56] References Cited

U.S. PATENT DOCUMENTS 4,361,129 11/1982 Sugie et al. ..... 123/622
4,463,744 8/1984 Tanaka et al. ..... 123/643
4,653,460 3/1987 Ooyabu et al. ..... 123/630

FOREIGN PATENT DOCUMENTS 55-66659 5/1980 Japan .
6-94864 11/1994 Japan .
10-176647 6/1998 Japan .

*Primary Examiner*—Henry C. Yuen
*Assistant Examiner*—Arnold Castro
*Attorney, Agent, or Firm*—Evenson, McKeown, Edwards & Lenahan, PLLC

[57] ABSTRACT

To provide an ignition device advantageous in cost and space by using an inexpensive small-sized Zener diode having a Zener voltage lower than an induced voltage generated at a primary current supply timing, so as to prevent sparking of a spark plug due to the induced voltage. An ignition device for an internal combustion engine, includes a Zener diode provided on the secondary lower-voltage side of an ignition coil. The Zener diode comes into conduction at a voltage lower than an induced voltage generated at a primary current supply timing.

4 Claims, 5 Drawing Sheets

IGNITION DEVICE FOR AN INTERNAL COMBUSTION ENGINE

BACKGROUND OF THE INVENTION

The present invention relates to a structure of an ignition device for an internal combustion engine.

Conventional methods for suppressing an induced voltage generated at a lower-voltage end of a secondary winding of an ignition coil at a primary current supply timing include a method using a high-voltage diode connected to a higher-voltage end of the secondary winding as described in Japanese Patent Laid-open No. 55-66659 and a method using a Zener diode connected to a lower-voltage end of the secondary winding, the Zener diode coming into conduction at a reverse voltage higher than the induced voltage generated at the lower-voltage end of the secondary winding as described in Japanese Patent Publication No. 6-94864. In each method, the diode used has a breakdown voltage higher than the induced voltage generated at the lower-voltage end of the secondary winding at the primary current supply timing. Accordingly, the diode is configured by using an element having a high withstand voltage.

In the prior art mentioned above, the use of the diode having a breakdown voltage higher than the induced voltage generated at the lower-voltage end of the secondary winding at the primary current supply timing requires an element having a high withstand voltage. However, such a diode having a high withstand voltage is expensive and bulky, causing a disadvantage in view of cost and space.

SUMMARY OF THE INVENTION

It is accordingly an object of the present invention to provide an ignition device which is advantageous in cost and space and can prevent the misignition in a spark plug due to the induced voltage generated at the lower-voltage end of the secondary winding at the primary current supply timing.

The diode is used for the purpose of preventing sparking of a spark plug by the induced voltage generated at the lower-voltage end of the secondary winding at the primary current supply timing. That is, the breakdown voltage of the diode is not necessarily set to a level higher than the induced voltage generated at the primary current supply timing, but the object can be achieved by using a Zener diode to offset the induced voltage to such a level that no spark discharge occurs even at a voltage lower than the induced voltage, thereby reducing a voltage between electrodes of a spark plug. Thus, the object of the present invention can be achieved by using a relatively low-voltage Zener diode that is inexpensive and less bulky.

DESCRIPTION OF THE PREFERRED EMBODIMENTS

The operation by the configuration by the present invention will now be described.

According to the configuration of the present invention, a Zener diode is connected to the lower-voltage end of the secondary winding of an ignition coil. The Zener diode comes into conduction at a reverse voltage lower than the induced voltage generated at the lower-voltage end of the secondary winding at the primary current supply timing, and has a sufficient Zener voltage to prevent misignition in a spark plug. Accordingly, even when an induced voltage is generated at the primary current supply timing, the generation of a spark in the spark plug can be prevented. A discharge voltage between electrodes of the spark plug is about 300 V or higher according to the theory of Paschen or about 1 kV or higher according to the practice in an automotive internal combustion engine. Accordingly, the Zener voltage is set on the basis of these voltage values to prevent the misignition.

Since the Zener diode is connected to the lower-voltage end of the secondary winding, the induced voltage at the primary current supply timing is offset by the Zener voltage, and the reverse voltage in the secondary winding is divided between the Zener diode and a discharge gap of the spark plug, thereby suppressing the discharge voltage in the spark plug. Further, since the Zener diode is connected to the lower-voltage end of the secondary winding, the Zener diode is not affected by a capacitive discharge current sparking through a secondary capacitance to the spark plug upon ignition at the primary current cutoff timing, thereby preventing the Zener diode from undergoing high voltage.

Figure 1:
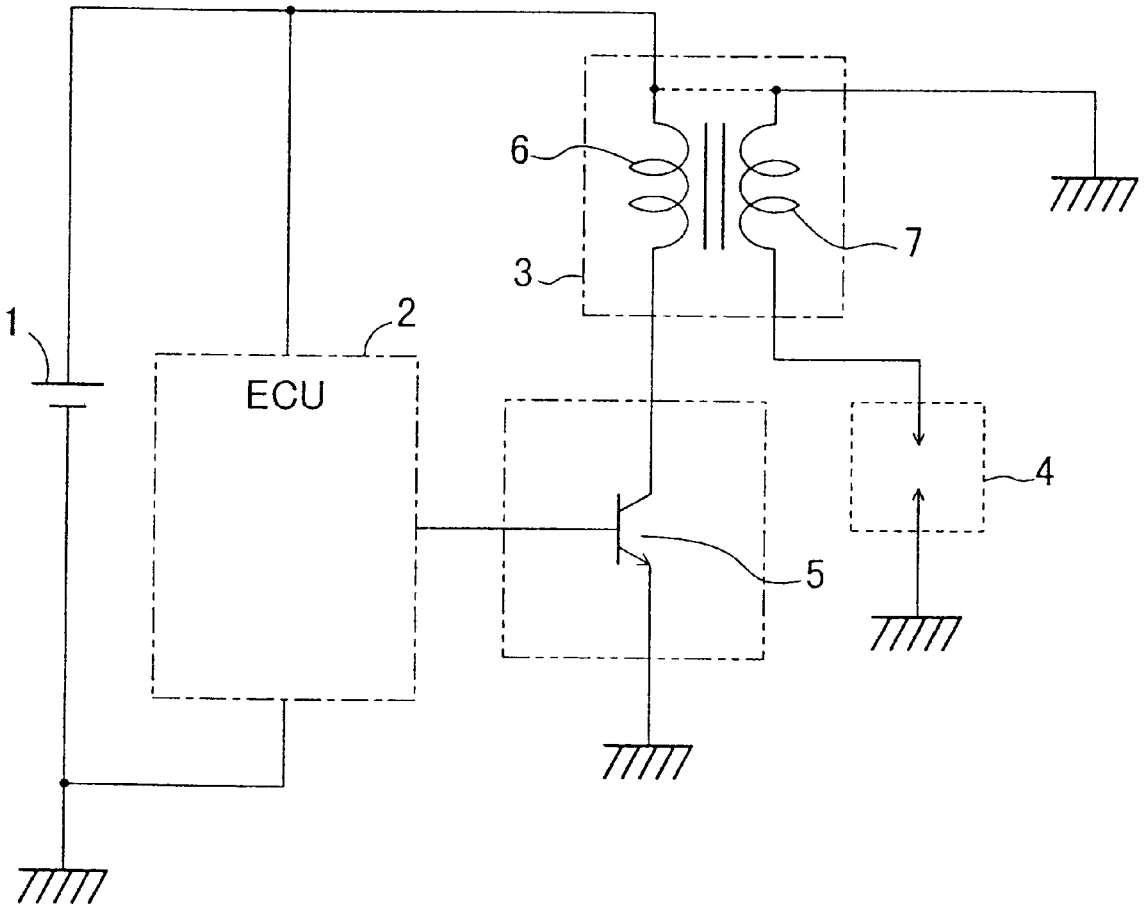
FIG. 1 PRIOR ART
FIG. 1 is a circuit diagram showing the configuration of an ignition system having no reverse voltage blocking diode.

FIG. 1 shows a typical configuration of an ignition system having no reverse voltage blocking diode. The ignition system shown in FIG. 1 includes a battery 1, an ECU 2, an ignition coil 3, a spark plug 4, and a power transistor 5. The ECU 2 outputs from its output stage HIGH and LOW pulses to the base of the power transistor 5 at a proper ignition timing, thereby switching the power transistor 5 on and off to generate a high voltage on the secondary side of the ignition coil 3. The ignition coil 3 includes a primary winding 6 having one end connected to the positive electrode of the battery 1 and the other end connected to the collector of the power transistor 5, and a secondary winding 7 having a higher-voltage end connected to one end of the spark plug 4 and the other lower-voltage end connected to the ground or to the positive electrode of the battery 1.

Figure 2:
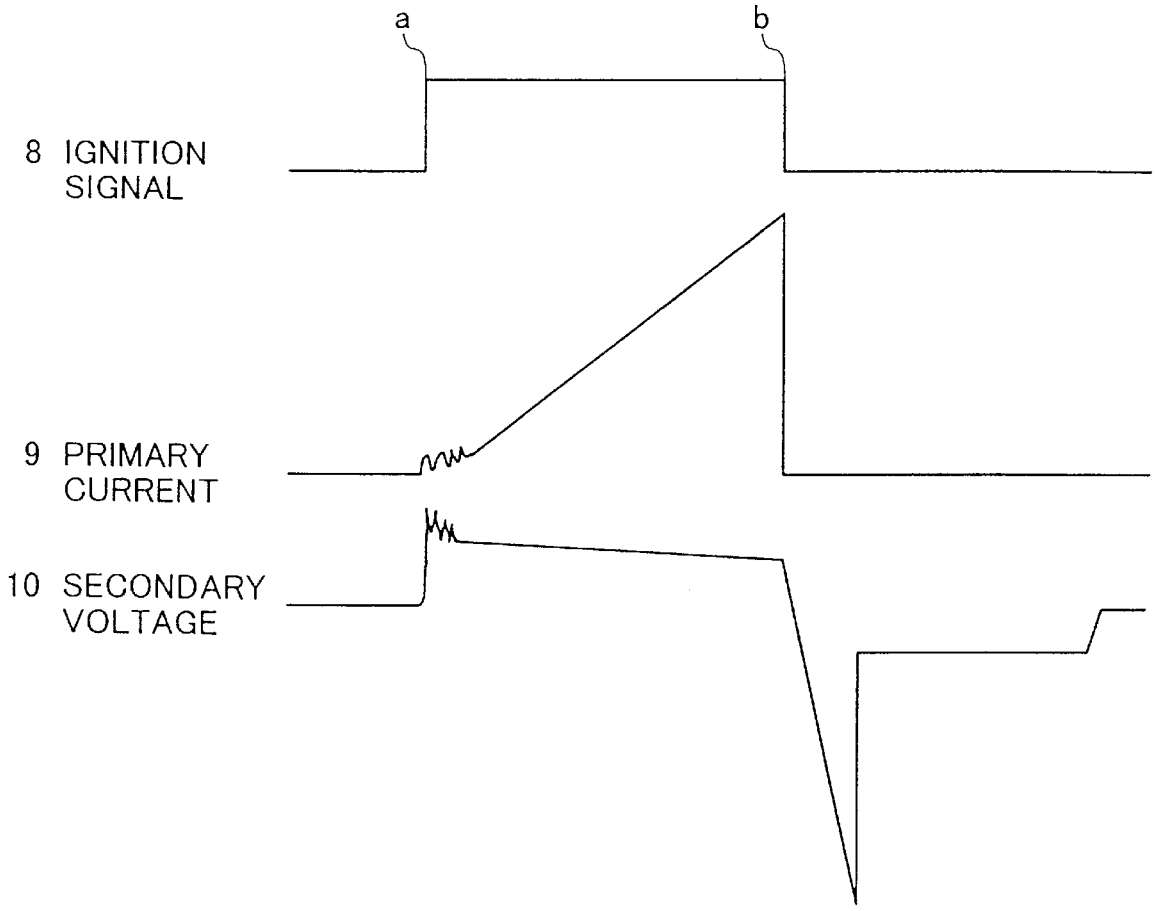
FIG. 2 PRIOR ART
FIG. 2 is a waveform chart showing the operation of the ignition system having no reverse voltage blocking diode shown in FIG. 1.

FIG. 2 shows waveforms of operation of the ignition system shown in FIG. 1. Reference numeral 8 denotes an ignition signal output from the ECU 2; reference numeral 9 denotes a primary current flowing in the primary winding 6 of the ignition coil 3; and reference numeral 10 denotes a secondary voltage generated in the secondary winding 7 of the ignition coil 3 and applied to the spark plug 4. The ignition signal 8 becomes HIGH at a proper ignition timing computed by the ECU 2, and simultaneously the primary current 9 starts flowing with a delay corresponding to the time constant for the inductance and resistance of the primary winding 6. Subsequently, the ignition signal 8 becomes LOW at a proper ignition timing b, and the primary current 9 is cut off to generate a high voltage at the higher-voltage end of the secondary winding 7 of the ignition coil 3. While spark discharge required for ignition occurs at a negative secondary voltage generated at the current cutoff timing b, a positive reverse voltage of about 1000 to 2000 V is also induced at the higher-voltage end of the secondary winding 7 at the current supply timing a.

Figure 3:
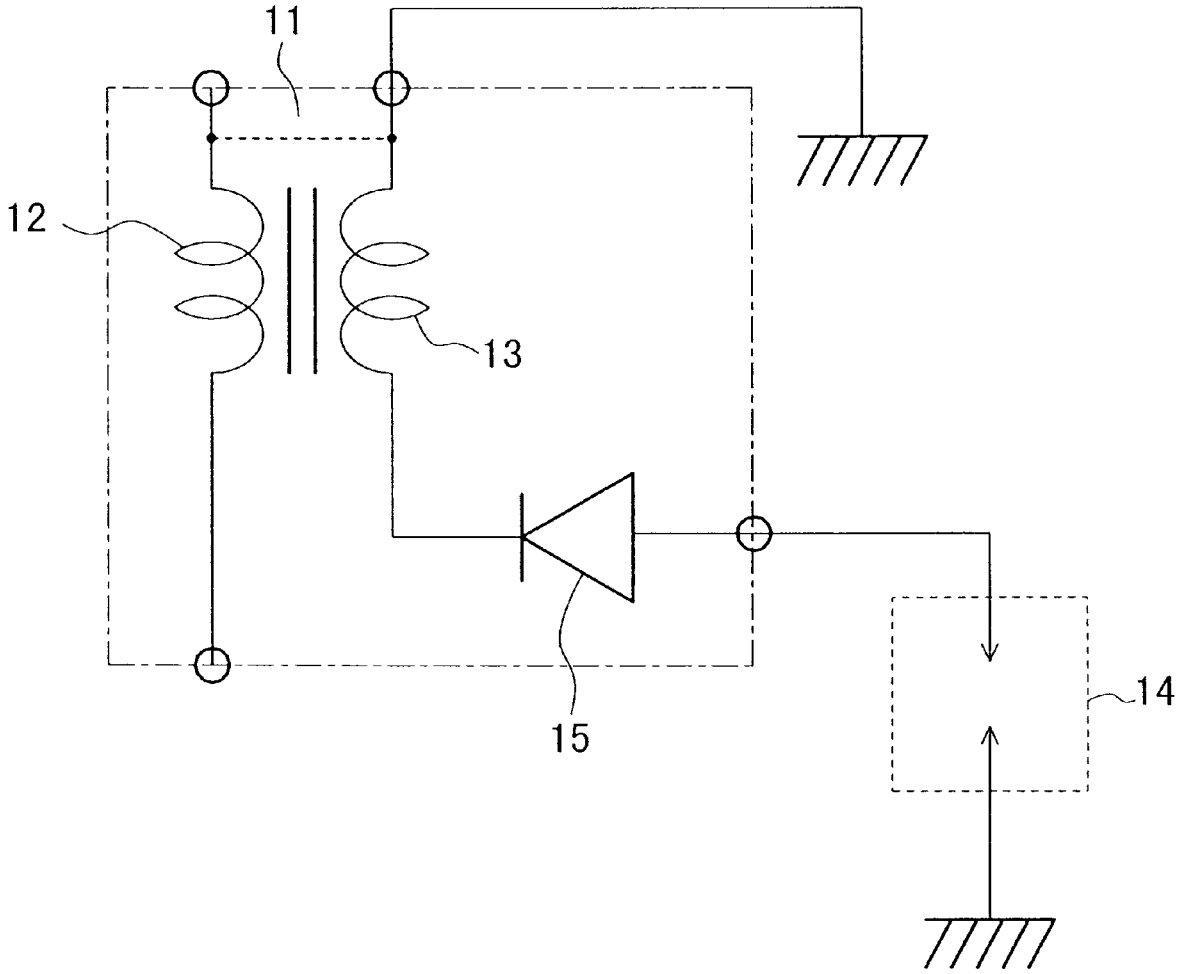
FIG.3 PRIOR ART
FIG. 3 is a circuit diagram showing the configuration of an ignition coil incorporating a high-voltage diode.

FIG. 3 shows a typical configuration of an ignition coil 11 having a reverse voltage blocking diode embedded at the higher-voltage end. The ignition coil 11 has a primary winding 12 and a secondary winding 13 magnetically coupled together through an iron core. The secondary winding 13 has a higher-voltage end connected through a high-voltage diode 15 to one end of a spark plug 14 and the other lower-voltage end connected to the ground or to the positive electrode of a battery. With this configuration, a reverse voltage is blocked by the high-voltage diode 15 connected to the higher-voltage end of the secondary winding 13 of the ignition coil 11, so that an induced voltage to the spark plug 14 at a primary current supply timing can be suppressed to about tens of volts. However, the diode 15 always undergoes a breakover voltage and an arc voltage upon ignition and a high induced voltage at the primary current supply timing. Further, a capacitive discharge current due to secondary capacitance in the ignition coil 11 flows in the diode 15. Accordingly, the diode 15 is in a very harsh environment.

Figure 4:
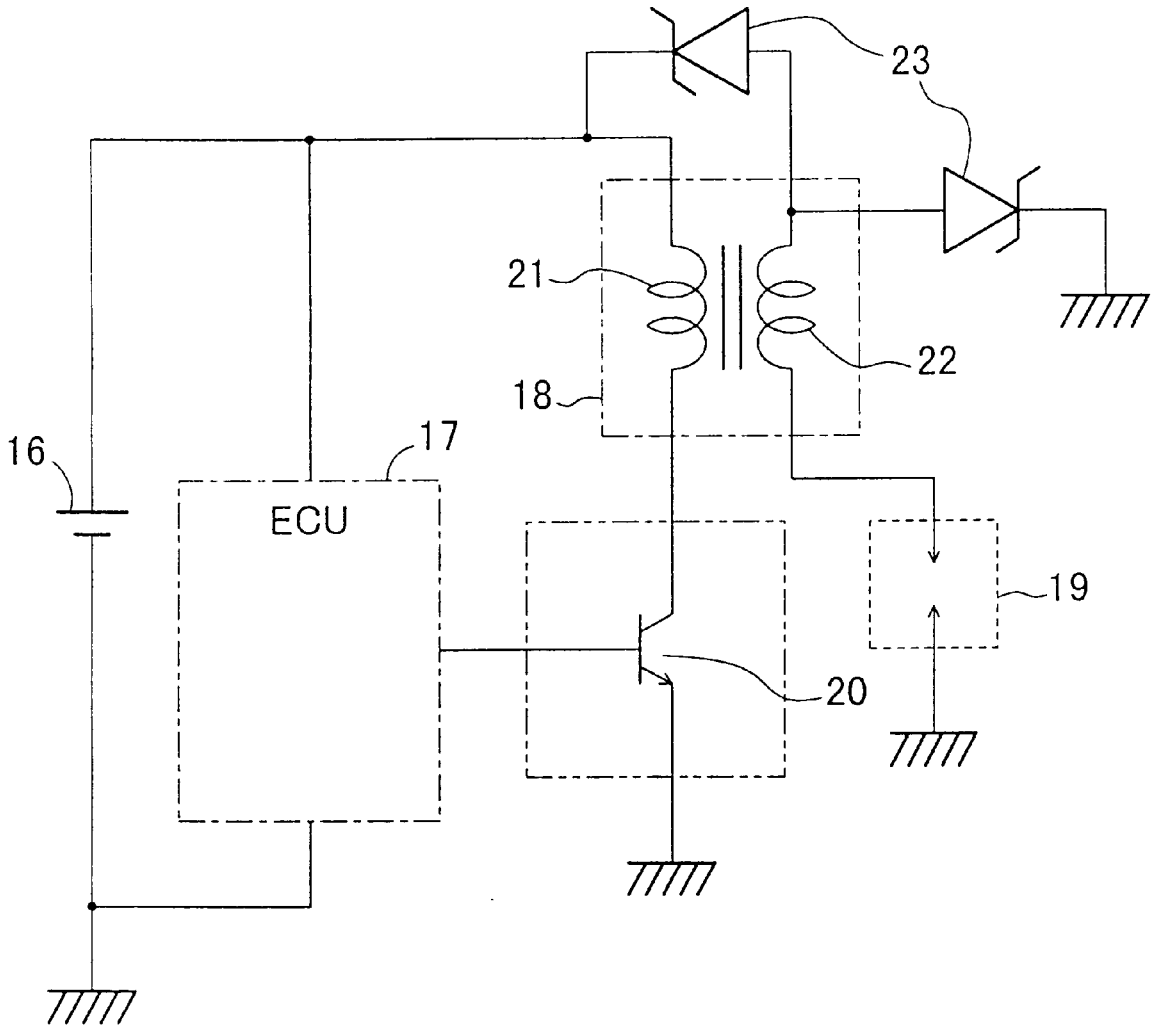
FIG. 4 is a circuit diagram showing the configuration of an ignition system according to the present invention.

FIG. 4 shows the configuration of an ignition system according to a preferred embodiment of the present invention. The ignition system shown in FIG. 4 includes a battery 16, an ECU 17, an ignition coil 18, a spark plug 19, a power transistor 20, and a Zener diode 23. The ignition coil 18 includes a primary winding 21 having one end connected to the positive electrode of the battery 16 and the other end connected to the collector of the power transistor 20 and a secondary winding 22 having a higher-voltage end connected to one end of the spark plug 19 and a lower-voltage end connected to the anode of the Zener diode 23. The cathode of the Zener diode 23 is connected to the ground or to the one end of the primary winding 21 (the positive electrode of the battery 16). The present invention is characterized in that the Zener voltage of the Zener diode 23 is set to a value slightly lower than an induced voltage generated at a primary current supply timing.

Figure 5:
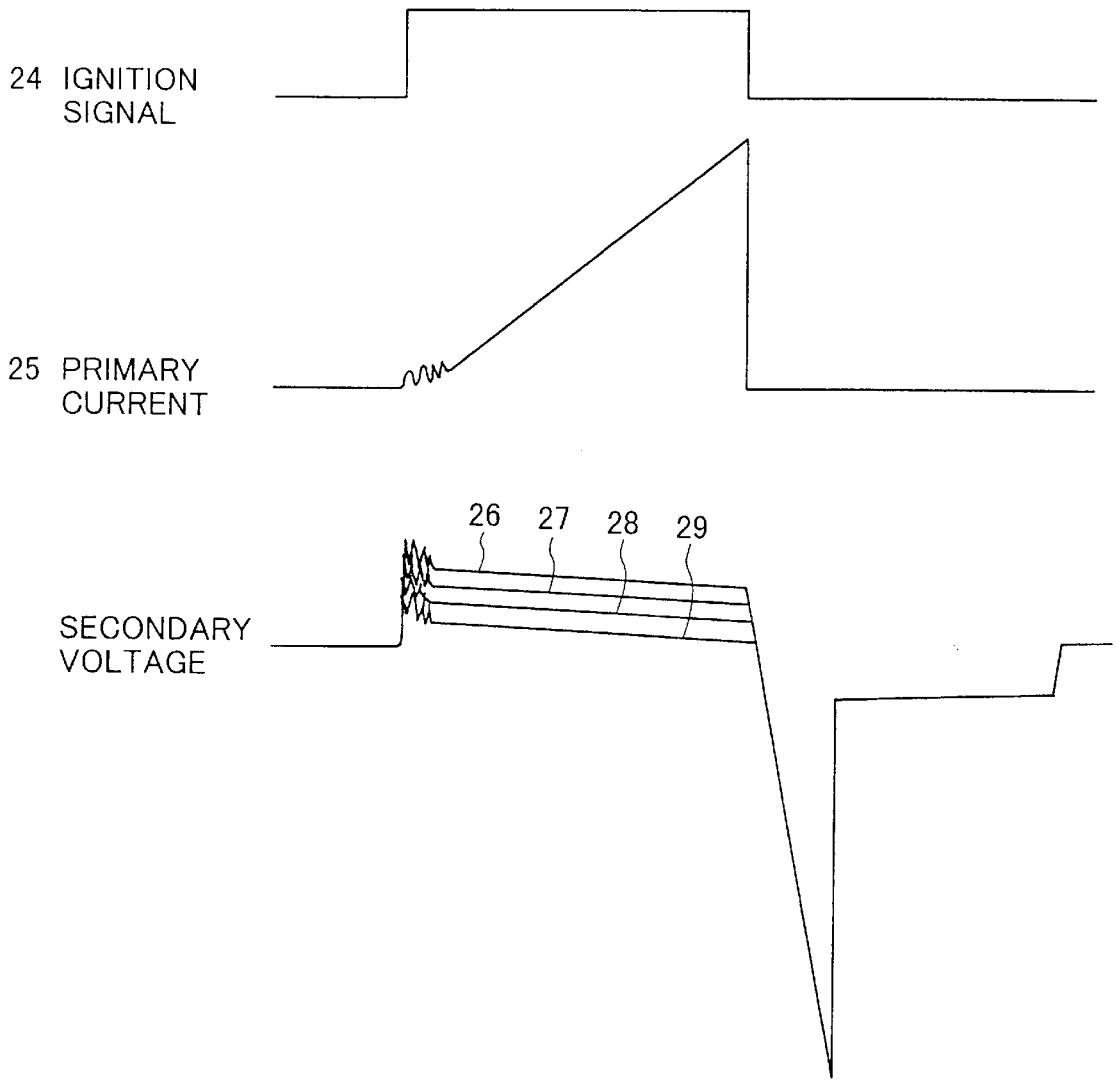
FIG. 5 is a waveform chart showing the operation of the ignition system shown in FIG. 4.

FIG. 5 shows an example of differences in induced voltage according to the Zener voltage of the Zener diode 23. Reference numeral 24 denotes an ignition signal output from the ECU 17; reference numeral 25 denotes a primary current; reference numeral 26 denotes a secondary voltage waveform in the case that the secondary lower-voltage end of the ignition coil 18 is connected directly to the ground; reference numeral 27 denotes a secondary voltage waveform in the case that the secondary lower-voltage end of the ignition coil 18 is connected to the Zener diode 23 having a Zener voltage of 400 V; reference numeral 28 denotes a secondary voltage waveform in the case that the secondary lower-voltage end of the ignition coil 18 is connected to the Zener diode 23 having a Zener voltage of 800 V; and reference numeral 29 denotes a secondary voltage waveform in the case that the secondary lower-voltage end of the ignition coil 18 is connected to the Zener diode 23 having a Zener voltage of 2000 V. While the induced voltage depends on the specifications of the ignition coil, the induced voltage can be changed by selecting the Zener voltage. Accordingly, misignition by a reverse spark possibly generated in the spark plug can be prevented by using the Zener diode having a withstand voltage lower than the induced voltage. For example, in the case that the battery voltage is 14 V and the ratio of turns in the coil is 100, the secondary voltage becomes 1400 V. Assuming that the sparking voltage is 1000 V or higher according to the theory of Paschen and the practice in an automotive internal combustion engine, it is sufficient to select a Zener diode having a Zener voltage of 400 V or higher. Further, assuming that the sparking voltage is 300 V or higher, it is sufficient to select a Zener diode having a Zener voltage of 1100 V or higher.

The advantages of the preferred embodiment having the above configuration will now be described. (a) The diode is not affected by a capacitive discharge current.

In the case that a high-voltage diode is embedded at the higher-voltage end of the ignition coil, the high-voltage diode is affected by load and heat due to a capacitive discharge current. However, the Zener diode 23 in this preferred embodiment is hardly affected. (b) The diode does not undergo high voltage.

In the case that a high-voltage diode is embedded at the higher-voltage end of the ignition coil, the high-voltage diode always undergoes a breakover voltage and an arc voltage upon sparking and an induced voltage at a primary current supply timing. However, the Zener diode in this preferred embodiment undergoes only an induced voltage at a primary current supply timing, thus taking an advantage in view of deterioration. (c) Reduction in device size by use of the low-voltage Zener diode.

In the case that a high-voltage diode is embedded at the higher-voltage end of the ignition coil, the high-voltage diode is essential to block an induced voltage at a primary current supply timing and withstand a spark plug open voltage. However, since the Zener diode is connected to the secondary lower-voltage end of the ignition coil in this preferred embodiment, such a high-voltage diode is not especially required because the Zener diode comes into conduction at a voltage beyond the Zener voltage. Further, in the case of intending to prevent the misignition of a spark plug due to an induced voltage at a primary current supply timing, the misignition of the spark plug can be prevented by setting a proper value of the Zener voltage lower than the induced voltage. Accordingly, a diode having a lower withstand voltage can be used, thereby allowing provision of an ignition device advantageous in view of cost and space.

The Zener diode provided on the secondary lower-voltage side of the ignition coil according to the present invention may be embedded in the ignition coil or may be mounted in the ignition system.

The present invention is effective especially in an independent ignition system such that a single spark plug and a single ignition coil are provided for each cylinder. In a separate ignition device such that it is not embedded for each ignition coil in an engine having two or more cylinders, the lower-voltage ends of the secondary windings of all the ignition coils may be commonly connected through the above-mentioned Zener diode to the ground or to one end of each primary winding (the positive electrode of the battery), thereby allowing a reduction in parts count and cost.

According to the present invention as described above, an induced voltage generated at a primary current supply timing can be suppressed to a level lower than that in the case of not providing a reverse voltage blocking diode, thereby preventing the misignition of a spark plug due to the induced voltage. Further, by using a low-voltage Zener diode, it is possible to provide an ignition device advantageous in view of cost and space.

What is claimed is:

1. An ignition device for an internal combustion engine, for generating a high voltage in a secondary winding of an ignition coil by turning on and off a switching element according to an ignition control signal output from an electronic control unit (ECU) for said internal combustion engine to on-off control a primary current flowing in a primary winding of said ignition coil comprising:

a Zener diode connected to a lower-voltage end of said secondary winding of said ignition coil in a reverse direction to an induced voltage generated at a timing of starting supply of said primary current, said induced voltage being defined by the product of a change in voltage between opposite ends of said primary winding and a ratio of turns in said ignition coil, said Zener diode coming into conduction at a voltage lower than said induced voltage at a secondary lower-voltage end of said ignition coil at a primary current supply timing, and at a voltage higher than a difference voltage between a sparking voltage and said induced voltage at the secondary lower-voltage end of said ignition coil at the primary current supply timing.

2. An ignition device according to claim 1, wherein the Zener voltage of said Zener diode is set to a level lower than said induced voltage generated at said timing and preventing misignition in said spark plug.

3. An ignition device according to claim 1, wherein the Zener voltage of said Zener diode is set to 300 to 1000 V according to the ratio of turns in said ignition coil.

4. An ignition device according to claim 2, wherein said level is a value based on the theory of Paschen.

* * * * *